US011555163B2

(12) United States Patent
Braeckman et al.

(10) Patent No.: US 11,555,163 B2
(45) Date of Patent: Jan. 17, 2023

(54) AQUEOUS LIQUID HAND DISHWASHING CLEANING COMPOSITION COMPRISING DISSOLVED AND HYDROLYZED POLYVINYL ALCOHOL

(71) Applicant: The Procter & Gamble Company, Cincinnati, OH (US)

(72) Inventors: Karl Ghislain Braeckman, Gerpinnes (BE); Pieter Jan Maria Saveyn, Destelbergen (BE); Mark Robert Sivik, Mason, OH (US); Evelyne Johanna Lutgarde Van Hecke, Bachte-Maria-Leerne (BE)

(73) Assignee: The Procter & Gamble Company, Cincinnati, OH (US)

( * ) Notice: Subject to any disclaimer, the term of this patent is extended or adjusted under 35 U.S.C. 154(b) by 20 days.

(21) Appl. No.: 16/857,891

(22) Filed: Apr. 24, 2020

(65) Prior Publication Data

US 2020/0339914 A1 Oct. 29, 2020

Related U.S. Application Data

(60) Provisional application No. 62/837,799, filed on Apr. 24, 2019.

(30) Foreign Application Priority Data

Oct. 2, 2019 (EP) ..... 19201031
Feb. 7, 2020 (EP) ..... 20156027

(51) Int. Cl.

| | |
|---|---|
| ***C11D 1/29*** | (2006.01) |
| ***C11D 1/14*** | (2006.01) |
| ***C11D 3/37*** | (2006.01) |
| ***C11D 17/00*** | (2006.01) |
| ***C11D 1/75*** | (2006.01) |
| ***C11D 11/00*** | (2006.01) |
| ***C11D 1/83*** | (2006.01) |

(52) U.S. Cl.

CPC ..... *C11D 1/146* (2013.01); *C11D 1/75* (2013.01); *C11D 1/83* (2013.01); *C11D 3/3753* (2013.01); *C11D 11/0035* (2013.01); *C11D 17/0008* (2013.01)

(58) Field of Classification Search

CPC .... C11D 1/29; C11D 1/75; C11D 1/90; C11D 3/0094; C11D 3/3753; C11D 11/0023; C11D 17/042

See application file for complete search history.

(56) References Cited

U.S. PATENT DOCUMENTS

| | | | | |
|---|---|---|---|---|
| 3,629,122 | A | 12/1971 | Jakobi | |
| 4,539,145 | A | 9/1985 | Alvarez | |
| 5,968,888 | A | 10/1999 | Blandiaux | |
| 8,759,274 | B2 * | 6/2014 | Dobrawa | C11D 3/3765 510/342 |
| 9,913,781 | B2 | 3/2018 | Morioka | |
| 2004/0147425 | A1 * | 7/2004 | Castro | C11D 17/049 510/438 |
| 2004/0167256 | A1 | 8/2004 | Verrall | |
| 2005/0107282 | A1 * | 5/2005 | Ford | C11D 3/37 510/438 |
| 2005/0170990 | A1 | 8/2005 | Hecht | |
| 2006/0052263 | A1 * | 3/2006 | Roreger | C11D 13/14 510/141 |
| 2011/0186467 | A1 | 8/2011 | Denome | |
| 2013/0296218 | A1 * | 11/2013 | Wang | D06M 15/285 510/400 |
| 2015/0099686 | A1 | 4/2015 | Silvernail | |
| 2017/0321161 | A1 * | 11/2017 | Lant | C11D 3/0094 |
| 2017/0321162 | A1 * | 11/2017 | Lant | C12Y 302/01004 |
| 2019/0292531 | A1 * | 9/2019 | Toscano | C11D 3/38627 |
| 2021/0387444 | A1 * | 12/2021 | Knight | C08J 7/048 |

FOREIGN PATENT DOCUMENTS

| | | | |
|---|---|---|---|
| CN | 104371855 | A | 2/2015 |
| CN | 104818134 | A | 8/2015 |
| CN | 107057861 | A | 8/2017 |
| EP | 0079185 | A1 | 5/1983 |
| EP | 0351162 | B2 | 9/2003 |
| GB | 916718 | A | 1/1963 |
| JP | 2002060793 | A | 2/2002 |
| JP | 2003027099 | A | 1/2003 |
| WO | WO9533025 | A1 | 12/1995 |
| WO | WO2012022008 | A1 | 2/2012 |
| WO | WO2013113541 | A1 | 8/2013 |
| WO | WO2018169532 | A1 | 9/2018 |

OTHER PUBLICATIONS

European Search Report for Application No./Patent No. 19201031.2-1106, dated Feb. 4, 2020, 7 pages.
Extended European Search Report and Search Opinion; Application No. 20156027.3; dated Apr. 6, 2020; 5 pages.
All Office Actions, U.S. Appl. No. 16/857,852.

* cited by examiner

*Primary Examiner* — Charles I Boyer
(74) *Attorney, Agent, or Firm* — Carolyn S. Powell; Melissa Gartstein Krasovec

(57) ABSTRACT

The need for a liquid hand dishwashing cleaning composition that is less hazy, while also provides reduced surface tension between the detergent composition and the soiled plate, and hence improvements in cleaning, is met when the liquid hand dishwashing cleaning composition is formulated with a surfactant system and a polyvinyl alcohol having a degree of hydrolysis of from about 40% to about 86%.

18 Claims, No Drawings

AQUEOUS LIQUID HAND DISHWASHING CLEANING COMPOSITION COMPRISING DISSOLVED AND HYDROLYZED POLYVINYL ALCOHOL

FIELD OF THE INVENTION

The present invention relates to a liquid hand dishwashing cleaning composition.

BACKGROUND OF THE INVENTION

While some consumers prefer to wash their dishes by submerging them into diluted liquid detergent compositions, many consumers prefer to apply the neat liquid detergent composition to the dish directly, or via an implement such as a sponge. Direct application provides improved grease cleaning, since a greater concentration of surfactant is applied directly to the stain. For direct application methods, consumers desire improved grease cleaning. While improved grease cleaning can be achieved by manipulating the surfactant system, or increasing the surfactant level, this can lead to haziness in the liquid detergent composition. One means of improving grease cleaning is through lowering the interfacial tension between the composition and the soiled dish-ware. Hence, a need remains for a liquid detergent composition for cleaning dishware, that is less hazy, while also provides reduced interfacial tension between the detergent composition and the soiled plate.

WO2012022008, WO 9533025, U.S. Pat. No. 5,968,888, and US 2005/0170990 A1 disclose methods for hand washing dishes, including the step of contacting the dishes with the liquid detergent composition in undiluted form.

U.S. Pat. No. 3,629,122A relates to low-foaming rinsing and washing compositions adapted for dish washers consisting essentially of (A) from 70% to 98% by weight of water-soluble polyvinyl alcohols having a molecular weight of between 1000 and 4000, and (B) from 2% to 30% by weight of foam-inhibiting compounds selected from the group consisting of aliphatic alcohols, aliphatic carboxylic acids and alkali metal salts thereof, aliphatic carboxylic acid amides and aliphatic amines, said compounds having at least one aliphatic or aliphatic-cycloaliphatic radical with from 8 to 22 carbon atoms, as well as aqueous solutions containing said lowfoaming rinsing and washing compositions. CN107057861A relates to a cleaning preparation for porcelain glazes and glass utensils. The cleaning preparation comprises solid acid, carbonate and/or hydrogen carbonate, thickener and/or stabilizer and surfactant and further comprises disinfecting agent, aromatic agent, deodorant and dispersant. CN104818134 relates to a tea scale detergent. The tea scale detergent is prepared by, by weight, 5-10 parts of sodium chloride, 3-8 parts of sodium dichloro isocyanurate, 7-11 parts of sodium lauryl polyoxyethylene ether sulphate, 1-3 parts of deoiling emulsifier, 3-7 parts of trichloro hydroxydiphenyl ether, 4-8 parts of sodium dodecyl benzene sulphonate, 3-5 parts of sodium sulphate, 5-10 parts of lauroyl diethanolamide, 3-9 parts of citric acid, 1-5 parts of poval, 4-6 parts of hexa polyglycerol monooctanoin ether, 1-3 parts of sodium carbonate, 6-10 parts of sucrose fatty acid ether and 80 parts of water. The tea scale detergent seeks to provide the benefits of being capable of quickly cleaning tea scale, extremely low in residue, harmless to the human body, little in foam and easy to clean.

U.S. Pat. No. 4,539,145A relates to an outside window cleaner comprising mixtures of one or more polyvinyl alcohols with water, or preferably, polyvinyl alcohol, a cationic polymer, such as trimethylol melamine, and water, alters or modifies window or other hard surfaces such that water drains off in uniform sheets, leaving virtually no residue or spots caused from the deposition of dirt, cleaning compositions or a combination of the two. In a further embodiment, a selected cationic or nonionic surfactant is added to the formula of this invention to improve detergency while retaining the uniform drainage advantage in rinsing.

CN104371855 relates to a low-foam glass cleaner which is prepared from the following raw materials in parts by weight: 6-8 parts of ethyl cellosolve, 3-9 parts of glycerol, 6-9 parts of borage seed oil, 6-9 parts of vaseline, 0.2-1 part of ammonia water, 5-8 parts of sodium bicarbonate, 6-8 parts of polyvinyl alcohol, 5-7 parts of sodium lauryl sulphate, 2-4 parts of silicone, 5-10 parts of alkanolamide, 5-11 parts of fatty alcohol polyethenoxy ether, 2-6 parts of butanediol, 3-6 parts of triethanolamine, 4-8 parts of cocamidopropyl betaine, 2-6 parts of sodium benzoate and 1-5 parts of tetradecyl alcohol. The low-foam glass cleaner has the advantages of low foam and low cost, is easy to clean, and has certain antifogging function in the cleaning process.

US 2006/052263A relates to a solid soap preparation which can dissolve very quickly when it comes into contact with water and which enables exact dosing of a specific amount of soap, the soap preparation contains air bubbles and thus exhibits a certain degree of elasticity and plasticity.

SUMMARY OF THE INVENTION

The present invention relates to a liquid hand dishwashing cleaning composition comprising from 5% to 50% by weight of the total composition of a surfactant system; and polyvinyl alcohol, wherein the polyvinyl alcohol has a degree of hydrolysis of from 40% to 86%, wherein the polyvinyl alcohol is present at a level of from 0.05% to 5.0%.

The present invention further relates to a process for making a liquid detergent composition of the invention, comprising the step of adding the polyvinyl alcohol to an aqueous medium, before adding the surfactant system.

The present invention further relates to a method for hand washing dishes, using a liquid detergent composition comprising: from 5% to 50% by weight of the total composition of a surfactant system and polyvinyl alcohol having a degree of hydrolysis of from 40% to 86%, wherein the method comprises the step of contacting the liquid detergent composition in its neat form, with the dishes.

DETAILED DESCRIPTION OF THE INVENTION

The liquid hand dishwashing cleaning compositions of the present invention provide a liquid detergent composition for cleaning dishware that is less hazy, while also provides reduced interfacial tension between the detergent composition and the soiled plate, and hence improvements in cleaning.

Definitions

As used herein, articles such as "a" and "an" when used in a claim, are understood to mean one or more of what is claimed or described.

The term "comprising" as used herein means that steps and ingredients other than those specifically mentioned can be added. This term encompasses the terms "consisting of"

and "consisting essentially of." The compositions of the present invention can comprise, consist of, and consist essentially of the essential elements and limitations of the invention described herein, as well as any of the additional or optional ingredients, components, steps, or limitations described herein.

The term "dishware" as used herein includes cookware and tableware made from, by non-limiting examples, ceramic, china, metal, glass, plastic (e.g., polyethylene, polypropylene, polystyrene, etc.) and wood.

The term "grease" or "greasy" as used herein means materials comprising at least in part (i.e., at least 0.5 wt % by weight of the grease) saturated and unsaturated fats and oils, preferably oils and fats derived from animal sources such as beef, pig and/or chicken.

The terms "include", "includes" and "including" are meant to be non-limiting.

The term "particulate soils" as used herein means inorganic and especially organic, solid soil particles, especially food particles, such as for non-limiting examples: finely divided elemental carbon, baked grease particle, and meat particles.

The term "sudsing profile" as used herein refers to the properties of a cleaning composition relating to suds character during the dishwashing process. The term "sudsing profile" of a cleaning composition includes suds volume generated upon dissolving and agitation, typically manual agitation, of the cleaning composition in the aqueous washing solution, and the retention of the suds during the dishwashing process. Preferably, hand dishwashing cleaning compositions characterized as having "good sudsing profile" tend to have high suds volume and/or sustained suds volume, particularly during a substantial portion of or for the entire manual dishwashing process. This is important as the consumer uses high suds as an indicator that sufficient cleaning composition has been dosed. Moreover, the consumer also uses the sustained suds volume as an indicator that sufficient active cleaning ingredients (e.g., surfactants) are present, even towards the end of the dishwashing process. The consumer usually renews the washing solution when the sudsing subsides. Thus, a low sudsing cleaning composition will tend to be replaced by the consumer more frequently than is necessary because of the low sudsing level.

It is understood that the test methods that are disclosed in the Test Methods Section of the present application must be used to determine the respective values of the parameters of Applicants' inventions as described and claimed herein.

In all embodiments of the present invention, all percentages are by weight of the total composition, as evident by the context, unless specifically stated otherwise. All ratios are weight ratios, unless specifically stated otherwise, and all measurements are made at 25° C., unless otherwise designated.

Cleaning Composition

The cleaning composition is a hand dishwashing cleaning composition in liquid form. The cleaning composition is preferably an aqueous cleaning composition. As such, the composition can comprise from 50% to 85%, preferably from 50% to 75%, by weight of the total composition of water.

Preferably, the pH of the composition is from about 6 to about 14, preferably from about 7 to about 12, or more preferably from about 7.5 to about 10, as measured at 10% dilution in distilled water at 20° C. The pH of the composition can be adjusted using pH modifying ingredients known in the art.

The composition of the present invention can be Newtonian or non-Newtonian, preferably Newtonian. Preferably, the composition has a viscosity of from 10 mPa·s to 10,000 mPa·s, preferably from 100 mPa·s to 5,000 mPa·s, more preferably from 300 mPa·s to 2,000 mPa·s, or most preferably from 500 mPa·s to 1,500 mPa·s, or alternatively combinations thereof. The viscosity is measured at 20° C. with a Brookfield RT Viscometer using spindle 31 with the RPM of the viscometer adjusted to achieve a torque of between 40% and 60%.

Surfactant System

The cleaning composition comprises from 5% to 50%, preferably from 6% to 40%, more preferably from 15% to 35%, by weight of the total composition of a surfactant system.

For improved sudsing, the surfactant system can comprise anionic surfactant. The surfactant system preferably comprises from 60% to 90% by weight of the surfactant system of the anionic surfactant. Alkyl sulphated anionic surfactants are preferred, particularly those selected from the group consisting of: alkyl sulphate, alkyl alkoxy sulphate, and mixtures thereof.

For further improvements in sudsing, the surfactant system can comprise less than 30%, preferably less than 15%, more preferably less than 10% of further anionic surfactant, and most preferably the surfactant system comprises no further anionic surfactant. The alkyl sulphated anionic surfactant preferably has an average alkyl chain length of from 8 to 18, preferably from 10 to 14, more preferably from 12 to 14, most preferably from 12 to 13 carbon atoms. The alkyl sulphated anionic surfactant has an average degree of alkoxylation, of less than 5, preferably less than 3, more preferably from 0.5 to 2.0, most preferably from 0.5 to 0.9. Preferably, the alkyl sulphated anionic surfactant is ethoxylated. That is, the alkyl sulphated anionic surfactant has an average degree of ethoxylation, of less than 5, preferably less than 3, more preferably from 0.5 to 2.0, most preferably from 0.5 to 0.9.

The average degree of alkoxylation is the mol average degree of alkoxylation (i.e., mol average alkoxylation degree) of all the alkyl sulphate anionic surfactant. Hence, when calculating the mol average alkoxylation degree, the mols of non-alkoxylated sulphate anionic surfactant are included:

$$\text{Mol average alkoxylation degree} = (x1 * \text{alkoxylation degree of surfactant } 1 + x2 * \text{alkoxylation degree of surfactant } 2 + \ldots)/(x1 + x2 + \ldots)$$

wherein x1, x2, . . . are the number of moles of each alkyl (or alkoxy) sulphate anionic surfactant of the mixture and alkoxylation degree is the number of alkoxy groups in each alkyl sulphate anionic surfactant.

The alkyl sulphate anionic surfactant can have a weight average degree of branching of more than 10%, preferably more than 20%, more preferably more than 30%, even more preferably between 30% and 60%, most preferably between 30% and 50%. The alkyl sulphate anionic surfactant can comprise at least 5%, preferably at least 10%, most preferably at least 25%, by weight of the alkyl sulphate anionic surfactant, of branching on the C2 position (as measured counting carbon atoms from the sulphate group for non-alkoxylated alkyl sulphate anionic surfactants, and the counting from the alkoxy-group furthest from the sulphate group for alkoxylated alkyl sulphate anionic surfactants). More preferably, greater than 75%, even more preferably greater than 90%, by weight of the total branched alkyl content consists of C1-C5 alkyl moiety, preferably C1-C2 alkyl moiety. It has been found that formulating the inventive compositions using alkyl sulphate surfactants having the aforementioned degree of branching results in improved low temperature stability. Such compositions require less solvent in order to achieve good physical stability at low temperatures. As such, the compositions can comprise lower levels of organic solvent, of less than 5.0% by weight of the cleaning composition of organic solvent, while still having improved low temperature stability. Higher surfactant branching also provides faster initial suds generation, but typically less suds mileage. The weight average branching, described herein, has been found to provide improved low temperature stability, initial foam generation and suds longevity.

The weight average degree of branching for an anionic surfactant mixture can be calculated using the following formula:

$$\text{Weight average degree of branching (\%)}=[(x1*\text{wt \% branched alcohol 1 in alcohol 1}+x2*\text{wt \% branched alcohol 2 in alcohol 2}+\ldots)/(x1+x2+\ldots)]*100$$

wherein x1, x2, . . . are the weight in grams of each alcohol in the total alcohol mixture of the alcohols which were used as starting material before (alkoxylation and) sulphation to produce the alkyl (alkoxy) sulphate anionic surfactant. In the weight average degree of branching calculation, the weight of the alkyl alcohol used to form the alkyl sulphate anionic surfactant which is not branched is included.

The weight average degree of branching and the distribution of branching can typically be obtained from the technical data sheet for the surfactant or constituent alkyl alcohol. Alternatively, the branching can also be determined through analytical methods known in the art, including capillary gas chromatography with flame ionisation detection on medium polar capillary column, using hexane as the solvent. The weight average degree of branching and the distribution of branching is based on the starting alcohol used to produce the alkyl sulphate anionic surfactant.

The alkyl chain of the alkyl sulphated anionic surfactant preferably has a mol fraction of C12 and C13 chains of at least 50%, preferably at least 65%, more preferably at least 80%, most preferably at least 90%. Suds mileage is particularly improved, especially in the presence of greasy soils, when the C13/C12 mol ratio of the alkyl chain is at least 50/50, preferably at least 57/43, preferably from 60/40 to 90/10, more preferably from 60/40 to 80/20, most preferably from 60/40 to 70/30, while not compromising suds mileage in the presence of particulate soils.

Suitable counterions include alkali metal cation earth alkali metal cation, alkanolammonium or ammonium or substituted ammonium, but preferably sodium.

Suitable examples of commercially available alkyl sulphate anionic surfactants include, those derived from alcohols sold under the Neodol® brand-name by Shell, or the Lial®, Isalchem®, and Safol® brand-names by Sasol, or some of the natural alcohols produced by The Procter & Gamble Chemicals company. The alcohols can be blended in order to achieve the desired mol fraction of C12 and C13 chains and the desired C13/C12 ratio, based on the relative fractions of C13 and C12 within the starting alcohols, as obtained from the technical data sheets from the suppliers or from analysis using methods known in the art.

In order to improve surfactant packing after dilution and hence improve suds mileage, the surfactant system can comprise an alkyl sulphate anionic surfactant and a co-surfactant. Preferred co-surfactants are selected from the group consisting of an amphoteric surfactant, a zwitterionic surfactant, and mixtures thereof. The co-surfactant is preferably an amphoteric surfactant, more preferably an amine oxide surfactant. The co-surfactant is included as part of the surfactant system.

The composition preferably comprises from 0.1% to 20%, more preferably from 0.5% to 15% and especially from 2% to 10% by weight of the cleaning composition of the co-surfactant. The surfactant system of the cleaning composition of the present invention preferably comprises from 10% to 40%, preferably from 15% to 35%, more preferably from 20% to 30%, by weight of the surfactant system of a co-surfactant. The alkyl sulphate anionic surfactant to the co-surfactant weight ratio can be from 1:1 to 8:1, preferably from 2:1 to 5:1, more preferably from 2.5:1 to 4:1.

As mentioned earlier, amine oxide surfactants are preferred for use as a co-surfactant. The amine oxide surfactant can be linear or branched, though linear are preferred. Suitable linear amine oxides are typically water-soluble, and characterized by the formula R1-N(R2)(R3)O wherein R1 is a C8-18 alkyl, and the R2 and R3 moieties are selected from the group consisting of C1-3 alkyl groups, C1-3 hydroxyalkyl groups, and mixtures thereof. For instance, R2 and R3 can be selected from the group consisting of: methyl, ethyl, propyl, isopropyl, 2-hydroxethyl, 2-hydroxypropyl and 3-hydroxypropyl, and mixtures thereof, though methyl is preferred for one or both of R2 and R3. The linear amine oxide surfactants in particular may include linear C10-C18 alkyl dimethyl amine oxides and linear C8-C12 alkoxy ethyl dihydroxy ethyl amine oxides.

Preferably, the amine oxide surfactant is selected from the group consisting of: alkyl dimethyl amine oxide, alkyl amido propyl dimethyl amine oxide, and mixtures thereof. Alkyl dimethyl amine oxides are preferred, such as C8-18 alkyl dimethyl amine oxides, or C10-16 alkyl dimethyl amine oxides (such as coco dimethyl amine oxide). Suitable alkyl dimethyl amine oxides include C10 alkyl dimethyl amine oxide surfactant, C10-12 alkyl dimethyl amine oxide surfactant, C12-C14 alkyl dimethyl amine oxide surfactant, and mixtures thereof. C12-C14 alkyl dimethyl amine oxide are particularly preferred.

Alternative suitable amine oxide surfactants include mid-branched amine oxide surfactants. As used herein, "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 can be from 10 to 24 carbon atoms, preferably from 12 to 20, and more preferably from 10 to 16. The number of carbon atoms for the one alkyl moiety (n1) is preferably the same or similar to the number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein. The amine oxide further comprises two moieties, independently selected from a C1-3 alkyl, a C1-3 hydroxyalkyl group, or a polyethylene oxide group containing an average of from about 1 to about 3 ethylene oxide groups. Preferably, the two moieties are selected from a C1-3 alkyl, more preferably both are selected as C1 alkyl.

Alternatively, the amine oxide surfactant can be a mixture of amine oxides comprising a mixture of low-cut amine oxide and mid-cut amine oxide. The amine oxide of the composition of the invention can then comprises:

a) from about 10% to about 45% by weight of the amine oxide of low-cut amine oxide of formula R1R2R3AO wherein R1 and R2 are independently selected from hydrogen, C1-C4 alkyls or mixtures thereof, and R3 is selected from C10 alkyls and mixtures thereof; and b) from 55% to 90% by weight of the amine oxide of mid-cut amine oxide of formula R4R5R6AO wherein R4 and R5 are independently selected from hydrogen, C1-C4 alkyls or mixtures thereof, and R6 is selected from C12-C16 alkyls or mixtures thereof In a preferred low-cut amine oxide for use herein R3 is n-decyl, with preferably both R1 and R2 being methyl. In the mid-cut amine oxide of formula R4R5R6AO, R4 and R5 are preferably both methyl.

Preferably, the amine oxide comprises less than about 5%, more preferably less than 3%, by weight of the amine oxide of an amine oxide of formula R7R8R9AO wherein R7 and R8 are selected from hydrogen, C1-C4 alkyls and mixtures thereof and wherein R9 is selected from C8 alkyls and mixtures thereof. Limiting the amount of amine oxides of formula R7R8R9AO improves both physical stability and suds mileage.

Suitable zwitterionic surfactants include betaine surfactants. Such betaine surfactants includes alkyl betaines, alkylamidobetaine, amidazoliniumbetaine, sulphobetaine (INCI Sultaines) as well as the Phosphobetaine, and preferably meets formula (I):

$$R^1—[CO—X(CH_2)_n]_x—N^+(R^2)(R_3)—(CH_2)_m—[CH(OH)—CH_2]_y—Y— \quad (I)$$

Wherein in formula (I),

R1 is selected from the group consisting of: a saturated or unsaturated C6-22 alkyl residue, preferably C8-18 alkyl residue, more preferably a saturated C10-16 alkyl residue, most preferably a saturated C12-14 alkyl residue;

X is selected from the group consisting of: NH, NR4 wherein R4 is a C1-4 alkyl residue, O, and S, n is an integer from 1 to 10, preferably 2 to 5, more preferably 3, x is 0 or 1, preferably 1, R2 and R3 are independently selected from the group consisting of: a C1-4 alkyl residue, hydroxy substituted such as a hydroxyethyl, and mixtures thereof, preferably both R2 and R3 are methyl, m is an integer from 1 to 4, preferably 1, 2 or 3, y is 0 or 1, and Y is selected from the group consisting of: COO, SO3, OPO(OR5)O or P(O)(OR5)O, wherein R5 is H or a C1-4 alkyl residue.

Preferred betaines are the alkyl betaines of formula (Ia), the alkyl amido propyl betaine of formula (Ib), the sulphobetaines of formula (Ic) and the amido sulphobetaine of formula (Id):

$$R^1—N(CH_3)_2)—CH_2COO— \quad (Ia)$$

$$R^1—CO—NH(CH_2)_3—N^+(CH_3)_2—CH_2COO— \quad (Ib)$$

$$R^1—N^+(CH_3)_2—CH_2CH(OH)CH_2SO_3— \quad (Ic)$$

$$R^1—CO—NH—(CH_2)_3—N^+(CH_3)_2—CH_2CH(OH)CH_2SO_3— \quad (Id)$$

in which R1 has the same meaning as in formula (I). Particularly preferred are the carbobetaines [i.e. wherein Y—═COO— in formula (I)] of formulae (Ia) and (Ib), more preferred are the alkylamidobetaine of formula (Ib).

Suitable betaines can be selected from the group consisting or [designated in accordance with INCI]: capryl/capramidopropyl betaine, cetyl betaine, cetyl amidopropyl betaine, cocamidoethyl betaine, cocamidopropyl betaine, cocobetaines, decyl betaine, decyl amidopropyl betaine, hydrogenated tallow betaine/amidopropyl betaine, isostearamidopropyl betaine, lauramidopropyl betaine, lauryl betaine, myristyl amidopropyl betaine, myristyl betaine, oleamidopropyl betaine, oleyl betaine, palmamidopropyl betaine, palmitamidopropyl betaine, palm-kernelamidopropyl betaine, stearamidopropyl betaine, stearyl betaine, tallowamidopropyl betaine, tallow betaine, undecylenamidopropyl betaine, undecyl betaine, and mixtures thereof. Preferred betaines are selected from the group consisting of: cocamidopropyl betaine, cocobetaines, lauramidopropyl betaine, lauryl betaine, myristyl amidopropyl betaine, myristyl betaine, and mixtures thereof. Cocamidopropyl betaine is particularly preferred.

Preferably, the surfactant system of the composition of the present invention further comprises from 1% to 25%, preferably from 1.25% to 20%, more preferably from 1.5% to 15%, most preferably from 1.5% to 5%, by weight of the surfactant system, of a non-ionic surfactant.

Suitable nonionic surfactants can be selected from the group consisting of: alkoxylated non-ionic surfactant, alkyl polyglucoside ("APG") surfactant, and mixtures thereof.

Suitable alkoxylated non-ionic surfactants can be linear or branched, primary or secondary alkyl alkoxylated non-ionic surfactants. Alkyl ethoxylated non-ionic surfactant are preferred. The ethoxylated non-ionic surfactant can comprise on average from 9 to 15, preferably from 10 to 14 carbon atoms in its alkyl chain and on average from 5 to 12, preferably from 6 to 10, most preferably from 7 to 8, units of ethylene oxide per mole of alcohol. Such alkyl ethoxylated nonionic surfactants can be derived from synthetic alcohols, such as OXO-alcohols and Fisher Tropsh alcohols, or from naturally derived alcohols, or from mixtures thereof. Suitable examples of commercially available alkyl ethoxylate nonionic surfactants include, those derived from synthetic alcohols sold under the Neodol® brand-name by Shell, or the Lial®, Isalchem®, and Safol® brand-names by Sasol, or some of the natural alcohols produced by The Procter & Gamble Chemicals company.

The compositions of the present invention can comprise alkyl polyglucoside ("APG") surfactant. The addition of alkyl polyglucoside surfactants have been found to improve sudsing beyond that of comparative nonionic surfactants such as alkyl ethoxylated surfactants. Preferably the alkyl polyglucoside surfactant is a C8-C16 alkyl polyglucoside surfactant, preferably a C8-C14 alkyl polyglucoside surfactant. The alkyl polyglucoside preferably has an average degree of polymerization of between 0.1 and 3, more preferably between 0.5 and 2.5, even more preferably between 1 and 2. Most preferably, the alkyl polyglucoside surfactant has an average alkyl carbon chain length between 10 and 16, preferably between 10 and 14, most preferably between 12 and 14, with an average degree of polymerization of between 0.5 and 2.5 preferably between 1 and 2, most preferably between 1.2 and 1.6. C8-C16 alkyl polyglucosides are commercially available from several suppliers (e.g., Simusol® surfactants from Seppic Corporation; and Glucopon® 600 CSUP, Glucopon® 650 EC, Glucopon® 600 CSUP/MB, and Glucopon® 650 EC/MB, from BASF Corporation).

Polyvinyl Alcohol

The liquid hand dishwashing composition comprises polyvinyl alcohol. Improved clarity and reduced interfacial tension between the detergent composition and the soiled plate is achieved when the polyvinyl alcohol is only partially hydrolysed, thereby leaving some acetate groups present. In particular, the polyvinyl alcohol has a degree of hydrolysis (dH) of from 40% to 86%, preferably from 45% to 85%, and most preferably from 70% to 82%. As is well known to the skilled person, the degree of hydrolysis is expressed as mol %. If the polyvinyl alcohol is hydrolyzed to the maximum possible extent (>99%), then the formation of hydrogen bonding can be very intense, resulting in a strong network in solution, in addition to reduced solubility of the polyvinyl alcohol, causing the detergent composition to turn hazy accordingly. As such, partially hydrolysed polyvinyl alcohol typically results in a looser and less strong network of the polyvinyl alcohol in the detergent composition. It is believed that aforementioned degree of hydrolysis of the polyvinyl alcohol results in improved dispersion of any polyvinyl alcohol-surfactant complexes, hence keeping the detergent composition clear, while the reduced interfacial tension improves the surfactancy at the liquid-water interface, particularly when the dish composition is applied neat to the soiled dishware. Addition of polyvinyl alcohol according to the invention also helps to maintain foam and reduce the average foam bubble size. Foam maintenance and smaller foam bubble sizes typically connotes increased product strength to consumers.

Polyvinyl alcohol (PVA) is typically manufactured by polymerizing vinyl acetate monomers and then substituting the acetate groups with hydroxyl groups by hydrolysis. The properties of polyvinyl alcohol are largely governed by the molecular weight and the degree of substitution (hydrolysis). Due to the difficulties of measuring molecular weight of polyvinyl alcohol, the molecular weight of polyvinyl alcohol is typically expressed as a viscosity. The polyvinyl alcohol of use in the present invention preferably has a viscosity of from 2.0 mPa·s to 15 mPa·s, more preferably from 2.5 mPa·s to 7.5 mPa·s, most preferably from 2.7 mPa·s to 3.5 mPa·s, when measured as a 4% aqueous solution in demineralised water at 20° C. The viscosity of the freshly made polyvinyl alcohol aqueous solution is measured using a Brookfield LV type viscometer with UL adapter as described in British Standard EN ISO 15023-2:2006 Annex E Brookfield Test method. Such low molecular weight polyvinyl alcohols are believed to further improve the dispersion of any polyvinyl alcohol—surfactant complexes, while also having further beneficial effects on the interfacial tension. Furthermore, the low molecular weight polyvinyl alcohols are easier to process and limit viscosity increase of the hand dishwashing composition.

The polyvinyl alcohol is preferably a homopolymer, i.e. solely comprising vinyl acetate and vinyl alcohol units, hence excluding further monomer or polymer modifications.

The polyvinyl alcohol is present at a level of from 0.05% to 5.0%, preferably from 0.1% to 3.5%, more preferably from 0.1% to 2.0% by weight of the composition.

Suitable polyvinyl alcohol is available from various suppliers, including Kuraray, Sekisui, Nippon Gohsei, and Shinetsu. Preferred polyvinyl alcohols include Poval® LM30 (45-51% dH), Poval 3-80 (2.8-3.3 m·Pa·s, 78.5-81.5% dH), Poval® L-508 (6.0-7.0 cps, 71.5-73.5% dH), Poval® 15-79 (13.0-17.0 cps, 79.3-83.7% dH), Poval® 5-74 (4.2-5.0 cps, 72.5-74.5% dH), Poval® 3-80 (2.8-3.3 cps, 78.5-81.5% dH), Poval® 40-80 (40 mPa·s, 80% dH), Poval® 30-75 (30 mPa·s, 75% dH), supplied by Kuraray.

Further improvements in the transparency of the liquid hand dishwashing composition can be achieved by adding the polyvinyl alcohol to an aqueous composition, before adding the surfactant system.

Amphiphilic Alkoxylated Polyalkyleneimine:

The composition of the present invention may further comprise from about 0.05% to about 2%, preferably from about 0.07% to about 1% by weight of the total composition of an amphiphilic polymer. Suitable amphiphilic polymers can be selected from the group consisting of: amphiphilic alkoxylated polyalkyleneimine and mixtures thereof. The amphiphilic alkoxylated polyalkyleneimine polymer has been found to reduce gel formation on the hard surfaces to be cleaned when the liquid composition is added directly to a cleaning implement (such as a sponge) before cleaning and consequently brought in contact with heavily greased surfaces, especially when the cleaning implement comprises a low amount to nil water such as when light pre-wetted sponges are used.

A preferred amphiphilic alkoxylated polyethyleneimine polymer has the general structure of formula (II):

(II)

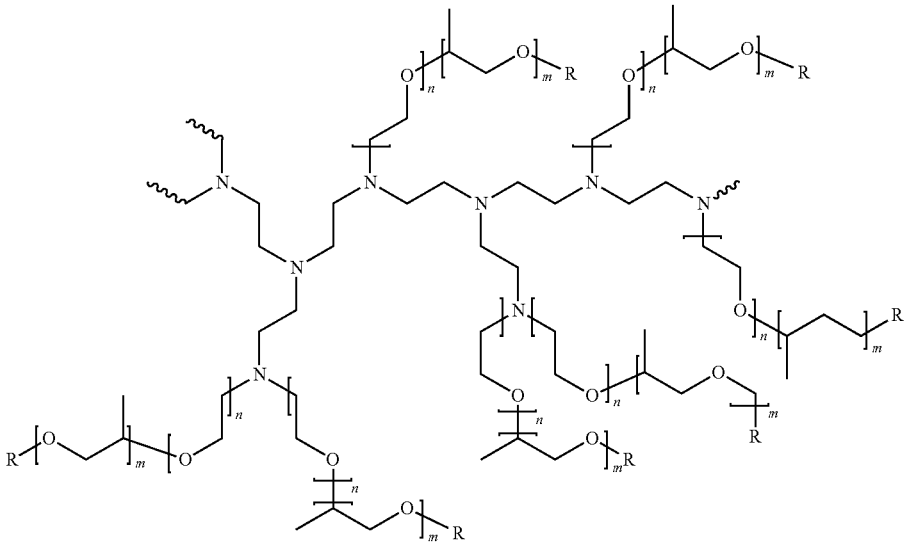

wherein the polyethyleneimine backbone has a weight average molecular weight of about 600, n of formula (II) has an average of about 10, m of formula (II) has an average of about 7 and R of formula (II) is selected from hydrogen, a $C_1$-$C_4$ alkyl and mixtures thereof, preferably hydrogen. The degree of permanent quaternization of formula (II) may be from 0% to about 22% of the polyethyleneimine backbone nitrogen atoms. The molecular weight of this amphiphilic alkoxylated polyethyleneimine polymer preferably is between 10,000 and 15,000 Da.

More preferably, the amphiphilic alkoxylated polyethyleneimine polymer has the general structure of formula (II) but wherein the polyethyleneimine backbone has a weight average molecular weight of about 600 Da, n of Formula (II) has an average of about 24, m of Formula (II) has an average of about 16 and R of Formula (II) is selected from hydrogen, a $C_1$-$C_4$ alkyl and mixtures thereof, preferably hydrogen. The degree of permanent quaternization of Formula (II) may be from 0% to about 22% of the polyethyleneimine backbone nitrogen atoms and is preferably 0%. The molecular weight of this amphiphilic alkoxylated polyethyleneimine polymer preferably is between 25,000 and 30,000, most preferably 28,000 Da.

The amphiphilic alkoxylated polyethyleneimine polymers can be made by the methods described in more detail in PCT Publication No. WO 2007/135645.

Cyclic Polyamine

The composition can comprise a cyclic polyamine having amine functionalities that helps cleaning. The composition of the invention preferably comprises from about 0.1% to about 3%, more preferably from about 0.2% to about 2%, and especially from about 0.5% to about 1%, by weight of the composition, of the cyclic polyamine.

The cyclic polyamine has at least two primary amine functionalities. The primary amines can be in any position in the cyclic amine but it has been found that in terms of grease cleaning, better performance is obtained when the primary amines are in positions 1,3. It has also been found that cyclic amines in which one of the substituents is —CH3 and the rest are H provided for improved grease cleaning performance.

Accordingly, the most preferred cyclic polyamine for use with the cleaning composition of the present invention are cyclic polyamine selected from the group consisting of: 2-methylcyclohexane-1,3-diamine, 4-methylcyclohexane-1, 3-diamine and mixtures thereof. These specific cyclic polyamines work to improve suds and grease cleaning profile through-out the dishwashing process when formulated together with the surfactant system of the composition of the present invention.

Additional Ingredients:

The composition of the present invention may further comprise at least one active selected from the group consisting of: i) a salt, ii) a hydrotrope, iii) an organic solvent, and mixtures thereof.

Salt:

The composition of the present invention may comprise from about 0.05% to about 2%, preferably from about 0.1% to about 1.5%, or more preferably from about 0.5% to about 1%, by weight of the total composition of a salt, preferably a monovalent or divalent inorganic salt, or a mixture thereof, more preferably selected from: sodium chloride, sodium sulphate, and mixtures thereof. Sodium chloride is most preferred.

Hydrotrope:

The composition of the present invention may comprise from about 0.1% to about 10%, or preferably from about 0.5% to about 10%, or more preferably from about 1% to about 10% by weight of the total composition of a hydrotrope or a mixture thereof, preferably sodium cumene sulphonate.

Organic Solvent:

The composition can comprise from about 0.1% to about 10%, or preferably from about 0.5% to about 10%, or more preferably from about 1% to about 10% by weight of the total composition of an organic solvent. Suitable organic solvents include organic solvents selected from the group consisting of: alcohols, glycols, glycol ethers, and mixtures thereof, preferably alcohols, glycols, and mixtures thereof. Ethanol is the preferred alcohol. Polyalkyleneglycols, especially polypropyleneglycol, is the preferred glycol.

Adjunct Ingredients

The cleaning composition may optionally comprise a number of other adjunct ingredients such as builders (preferably citrate), chelants, conditioning polymers, other cleaning polymers, surface modifying polymers, structurants, emollients, humectants, skin rejuvenating actives, enzymes, carboxylic acids, scrubbing particles, perfumes, malodor control agents, pigments, dyes, opacifiers, pearlescent particles, inorganic cations such as alkaline earth metals such as Ca/Mg-ions, antibacterial agents, preservatives, viscosity adjusters (e.g., salt such as NaCl, and other mono-, di- and trivalent salts) and pH adjusters and buffering means (e.g. carboxylic acids such as citric acid, HCl, NaOH, KOH, alkanolamines, carbonates such as sodium carbonates, bicarbonates, sesquicarbonates, and alike).

Process of Making

In a preferred process for making a liquid detergent composition according to the invention, the polyvinyl alcohol, typically commercially available as a powder, is predissolved in an aqueous composition using methods well known to the skilled person, before adding the surfactant system. The polyvinyl alcohol can be added to the aqueous composition at any suitable temperature under normal mixing, for instance, in the range 15° C. to 85° C., though lower temperatures of from 15° C. to 25° C. are preferred. The mixture is agitated until the aqueous solution is visually clear such that it is free of remaining polyvinyl alcohol particles. If heating is used to accelerate dissolution of the polyvinyl alcohol, the aqueous solution should be cooled sufficiently slowly to ensure proper hydration and hence full polyvinyl alcohol dissolution takes place in the detergent composition. It is believed that the addition of the polyvinyl alcohol to the aqueous composition before the addition of the surfactant system results in improved dissolution of the partially hydrolysed polyvinyl alcohol. Preferably, demineralised water is used. Preferably, the polyvinyl alcohol is dissolved in demineralized water, before the addition of any other component, such as the surfactant system, solvents, hydrotropes, polymers, salts, preservatives, perfume, colorants, and the like.

Method of Washing

The invention is further directed to a method for hand washing dishes, using a liquid detergent composition comprising: polyvinyl alcohol having a degree of hydrolysis of from 40% to 86%, wherein the method comprises the step of contacting the liquid detergent composition in its neat form, with the dishes. As mentioned earlier, the compositions of the present invention result in reduced interfacial tension between the liquid and soiled dishware, especially when the composition is applied neat to the soiled dishware.

By "in its neat form", it is meant herein that the composition is applied directly onto the surface to be treated, or onto a cleaning device or implement such as a brush, a sponge, a nonwoven material, or a woven material, without undergoing any significant dilution by the user (immediately) prior to application. "In its neat form", also includes slight dilutions, for instance, arising from the presence of water on the cleaning device, or the addition of water by the consumer to remove the remaining quantities of the composition from a bottle. Therefore, the composition in its neat form includes mixtures having the composition and water at ratios ranging from greater than 70:30, more preferably greater than 80:20, even more preferably greater than 90:10, depending on the user habits and the cleaning task. For the avoidance of doubt, a ratio of 100:0 is most preferred.

Prior to the application of said composition, the soiled dish may be immersed into a water bath, or held under running water, to wet the surface of the dish.

The method may comprise an optional rinsing step, after the step of contacting the liquid detergent composition with the dishes.

Test Methods

The following assays set forth must be used in order that the invention described and claimed herein may be more fully understood.

Test Method 1: Surface Tension

Test solutions are prepared by diluting 0.05 gram of the composition to be tested in 49.95 gram of deionized water, thus creating a 0.1% product solution. The surface tension of a test solution (22+/−0.5° C.) is measured with a Bubble Pressure Tensiometer BP50 from Kruss in a temperature and humidity controlled lab: 22+/−0.5° C.-35+/−5% RH. The settings on the instrument are selected as follows:

Start at surface age: 15 ms

Stop at surface age: 5000 ms

Values for mean: 10

A calibration is performed with deionized water. The surface tension measurement is started at a surface age of 15 ms to 5 s. The surface tension after 5 seconds is recorded as the mean of 10 individual measurements. Then the surface tension of each test solution is measured in triplicate.

EXAMPLE

The following examples are provided to further illustrate the present invention and are not to be construed as limitations of the present invention, as many variations of the present invention are possible without departing from its scope.

Example 1: Inventive and Comparative Compositions Comprising an Anionic Surfactant, Nonionic Surfactant, and Amine Oxide Surfactant System The inventive examples 1 and 2, and comparative examples A to C in Table 1 comprise an anionic surfactant, nonionic surfactant, and amine oxide. The pH of the examples was between 8.9 and 9.1. Polyvinylalcohol (PVOH) with different degrees of hydrolysis and molecular weight (unless otherwise mentioned expressed by its viscosity in a 4% aqueous solution at 20° C.) were added to make the examples.

Poval LM30: degree of hydrolysis (dH) 45-51 mol %, viscosity not measured since the solubility of polyvinyl alcohol having a dH of ~50 is less than 4% in water.

Poval 3-80: degree of hydrolysis (dH) 78.5-81.5 mol %, 2.8-3.3 mPa·s

Sigma Aldrich polyvinyl alcohol 4-98: degree of hydrolysis (dH) 98.0-98.8 mol %, 4.0-5.0 mPa·s Poval 18-88: degree of hydrolysis (dH) 86.7-88.7 mol %, 16.5-19.5 mPa·s

TABLE 1

Composition of inventive and comparative examples comprising an anionic surfactant and amine oxide surfactant system.

| | Ex. A* wt % | Ex. 1 wt % | Ex. 2 wt % | Ex. B* wt % | Ex. C* wt % |
|---|---|---|---|---|---|
| C12-13 $AE_{0.6}S$ anionic surfactant (avg branching: 37.84%) | 4.24 | 4.24 | 4.24 | 4.24 | 4.24 |
| C12-14 dimethyl amine oxide | 1.44 | 1.44 | 1.44 | 1.44 | 1.44 |
| Neodol 91-8 nonionic surfactant | 0.22 | 0.22 | 0.22 | 0.22 | 0.22 |
| Polypropylene glycol (mw 2000) | 0.19 | 0.19 | 0.19 | 0.19 | 0.19 |
| Ethanol | 0.53 | 0.53 | 0.53 | 0.53 | 0.53 |
| NaCl | 0.15 | 0.15 | 0.15 | 0.15 | 0.15 |
| Alkoxylated polyethyleneimine (PEI600EO24PO16)[1] | 0.051 | 0.051 | 0.051 | 0.051 | 0.051 |
| NaOH | 0.033 | 0.033 | 0.033 | 0.033 | 0.033 |
| Poval LM30 | — | 2 | — | — | — |
| Poval 3-80 | — | — | 2 | — | — |
| Poval 18-88 | — | — | — | 2 | — |
| Sigma Aldrich PVA 4-98 | — | — | — | — | 2 |
| Water and minors (perfume, dye, preservative) | | | Balance | | |

*Comparative

[1]amphiphilic alkoxylated polyethyleneimine (total MW: about 28000) with a polyethyleneimine backbone of MW 600 and alkoxylation chains each chain comprising 24 internal EO units and 16 terminal PO units, available from BASF.

The surface tension of 0.1% aqueous solutions of comparative examples A to C and inventive examples 1 and 2 was measured after 5 seconds and shown in Table 2. The standard deviation was calculated based on 3 sets of replicates. For reference, the surface tension of deionized water after 5 seconds was 72.6±0.8 mN/m.

TABLE 2

| surface tension and the difference in surface tension versus the non-PVOH containing reference Ex. A: | | | | | |
|---|---|---|---|---|---|
| | Ex. A* | Ex. 1 | Ex. 2 | Ex. B* | Ex. C* |
| PVOH degree hydrolysis | | 45-51% | 78.5-81.5% | 86.7-88.7% | 98.0-98.8% |
| Viscosity of PVOH (mPa · s)** | | N/A | 2.8-3.3 | 16.5-19.5 | 4.0-5.0 |
| Surface tension [mN/m] | 57.5 ± 0.8 | 54.4 ± 0.5 | 53.9 ± 0.2 | 55.8 ± 0.1 | 55.5 ± 0.3 |
| Difference in surface tension [mN/m] | Ref. | −3.1 | −3.6 | −1.6 | −2.0 |
| Clarity | transparent | transparent | transparent | transparent | cloudy |

**4% aqueous solution at 20° C.

As can be seen from the above data, the compositions of the present invention, comprising polyvinyl alcohol having a degree of hydrolysis of from 40% to 86% results in a reduced surface tension and hence improvements in grease emulsification. In addition, the compositions having a polyvinyl alcohol with a degree of hydrolysis of less than 85% exhibit improved clarity.

Example 2: Composition of Inventive and Comparative Examples Comprising an Anionic Surfactant and Cocoamidopropyl Betaine Surfactant System The inventive and comparative examples in Table 3 comprise cocoamidopropyl betaine. The pH of the examples was between 8.9 and 9.1. Polyvinylalcohol (PVOH) with different degrees of hydrolysis and molecular weight (unless otherwise mentioned expressed by its viscosity in a 4% aqueous solution at 20° C.) were added to make the examples.

TABLE 3

| Composition of inventive and comparative examples comprising an anionic surfactant and cocoamidopropyl betaine surfactant system | | | | | |
|---|---|---|---|---|---|
| | Ex. D* wt % | Ex. 3 wt % | Ex. 4 wt % | Ex. E* wt % | Ex. F* wt % |
| C12-13 $AE_{0.6}S$ anionic surfactant (avg branching: 37.84%) | 4.5 | 4.5 | 4.5 | 4.5 | 4.5 |
| Cocoamidopropyl Betaine | 1.5 | 1.5 | 1.5 | 1.5 | 1.5 |
| NaCl | 0.37 | 0.37 | 0.37 | 0.37 | 0.37 |
| Alkoxylated polyethyleneimine (PEI600EO24PO16)[1] | 0.051 | 0.051 | 0.051 | 0.051 | 0.051 |
| NaOH | 0.039 | 0.039 | 0.039 | 0.039 | 0.039 |
| Poval LM30 | — | 2 | — | — | — |
| Poval 3-80 | — | — | 2 | — | — |
| Poval 18-88 | — | — | — | 2 | — |
| Sigma Aldrich PVA 4-98 | — | — | — | — | 2 |
| Water and minors (perfume, dye, preservative) | | | Balance | | |

As before, the surface tension of a 0.1% aqueous solution of the examples was measured after 5 seconds and are shown in Table 4. The standard deviation was calculated based on 3 sets of replicates.

TABLE 4 surface tension and the difference in surface tension versus the non-PVOH containing reference Ex. D:

| | Ex. D* | Ex. 3 | Ex. 4 | Ex. E* | Ex. F* |
|---|---|---|---|---|---|
| PVOH degree hydrolysis | — | 45-51% | 78.5-81.5% | 86.7-88.7% | 98.0-98.8% |
| Viscosity of PVOH (mPa · s)** | — | N/A | 2.8-3.3 | 16.5-19.5 | 4.0-5.0 |
| Surface tension [mN/m] | 65.1 ± 0.2 | 61.0 ± 0.1 | 61.8 ± 0.2 | 62.5 ± 0.3 | 64.9 ± 0.1 |
| Difference in surface tension [mN/m] | Ref. | −4.1 | −3.3 | −2.6 | −0.2 |
| Clarity | transparent | transparent | transparent | transparent | cloudy |

As can be seen from the above data, benefit from polyvinyl alcohols having a degree of hydrolysis of from 40% to 86% are seen in formulations which comprise zwitterionic (betaine) surfactant instead of amphoteric (amine oxide) surfactant.

Example 3: Inventive and Comparative Compositions Comprising an Anionic Surfactant, Nonionic Surfactant, and Amine Oxide Surfactant System The inventive examples 5 and 6, and comparative examples G and H in Table 5 comprise an anionic surfactant, nonionic surfactant, and amine oxide. The pH of the examples was between 8.9 and 9.1. Polyvinyl alcohol (PVOH) with different degrees of hydrolysis and molecular weight (unless otherwise mentioned expressed by its viscosity in a 4% aqueous solution at 20° C.) were added to make the examples.

TABLE 5

Composition of inventive and comparative examples comprising an anionic surfactant and amine oxide surfactant system.

| | Ex. 5 wt % | Ex. 6 wt % | Ex. G* wt % | Ex. H* wt % |
|---|---|---|---|---|
| C12-13 $AE_{0.6}S$ anionic surfactant (avg branching: 37.84%) | 19.6 | 19.6 | 19.6 | 19.6 |
| C12-14 dimethyl amine oxide | 6.53 | 6.53 | 6.53 | 6.53 |
| Neodol 91-8 nonionic surfactant | 1 | 1 | 1 | 1 |
| Polypropylene glycol (mw 2000) | 0.85 | 0.85 | 0.85 | 0.85 |
| Ethanol | 2.4 | 2.4 | 2.4 | 2.4 |
| NaCl | 0.7 | 0.7 | 0.7 | 0.7 |
| Alkoxylated polyethyleneimine (PEI600EO24PO16)[1] | 0.23 | 0.23 | 0.23 | 0.23 |
| NaOH | 0.15 | 0.15 | 0.15 | 0.15 |
| Poval LM30 | 2 | — | — | — |
| Poval 3-80 | — | 2 | — | — |
| Poval 18-88 | — | — | 2 | — |
| Sigma Aldrich PVA 4-98 | — | — | — | 2 |
| Water and minors (perfume, dye, preservative) | | Balance | | |
| Clarity | Transparent | Transparent | Cloudy | Cloudy |

*Comparative

Inventive examples (ex. 5 and 6) demonstrate that compositions comprising polyvinylalcohol having a degree of hydrolysis between 40% and 86% maintain their transparency, even at higher surfactant levels.

Example 4: Composition of Inventive and Comparative Examples Comprising an Anionic Surfactant and Cocoamidopropyl Betaine Surfactant System The inventive examples 7 and 8, and comparative examples I and J in Table 6 comprise anionic surfactant and cocoamidopropyl betaine. The pH of the examples was between 8.9 and 9.1. Polyvinylalcohol (PVOH) with different degrees of hydrolysis and molecular weight (unless otherwise mentioned expressed by its viscosity in a 4% aqueous solution at 20° C.) were added to make the examples.

TABLE 6

Composition of inventive and comparative examples comprising an anionic surfactant and cocoamidopropyl betaine surfactant system

| | Ex. 7 wt % | Ex. 8 wt % | Ex. I* wt % | Ex. J* wt % |
|---|---|---|---|---|
| C12-13 $AE_{0.6}S$ anionic surfactant (avg branching: 37.84%) | 12.12 | 12.12 | 12.12 | 12.12 |
| Cocoamidopropyl Betaine | 4.04 | 4.04 | 4.04 | 4.04 |
| NaCl | 1 | 1 | 1 | 1 |
| Alkoxylated polyethyleneimine (PEI600EO24PO16)[1] | 0.14 | 0.14 | 0.14 | 0.14 |
| NaOH | 0.1 | 0.1 | 0.1 | 0.1 |
| Poval LM30 | 2 | — | — | — |
| Poval 3-80 | — | 2 | — | — |
| Poval 18-88 | — | — | 2 | — |
| Sigma Aldrich PVA 4-98 | — | — | — | 2 |
| Water and minors (perfume, dye, preservative) | | | | |
| Clarity | Transparent | Transparent | Cloudy | Cloudy |

*Comparative

[1]amphiphilic alkoxylated polyethyleneimine (total MW: about 28000) with a polyethyleneimine backbone of MW 600 and alkoxylation chains each chain comprising 24 internal EO units and 16 terminal PO units, available from BASF.

Inventive examples (ex. 5 and 6) comprising polyvinylalcohol with a degree of hydrolysis between 40% and 86% show improved clarity over the comparative examples I and J, and hence demonstrate that compositions comprising the polyvinyl alcohol of use in the present invention can maintain their transparency, even at higher surfactant levels.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid hand dishwashing cleaning composition comprising:

from 5% to 50% of a surfactant system by weight of the liquid hand dishwashing cleaning composition, wherein the surfactant system comprises alkyl sulphated anionic surfactant, and has an average alkyl chain length of from 8 to 18 carbon atoms;

polyvinyl alcohol, wherein the polyvinyl alcohol has a degree of hydrolysis of from 40% to less than 85%, wherein the polyvinyl alcohol is present at a level of from 0.05% to 5.0% by weight of the liquid hand dishwashing cleaning composition; and from 50% to 85% water by weight of the liquid hand dishwashing cleaning composition.

2. The liquid hand dishwashing cleaning composition according to claim 1, wherein the polyvinyl alcohol is present at a level of from 0.1% to 3.5% by weight of the composition.

3. The liquid hand dishwashing cleaning composition according to claim 2, wherein the polyvinyl alcohol is present at a level of from 0.5% to 2.0% by weight of the composition.

4. The liquid hand dishwashing cleaning composition according to claim 1, wherein the polyvinyl alcohol has a degree of degree of hydrolysis of from 45% to less than 85%.

5. The liquid hand dishwashing cleaning composition according to claim 4, wherein the polyvinyl alcohol has a degree of hydrolysis of from 70% to 82%.

6. The liquid hand dishwashing cleaning composition according to claim 1, wherein the polyvinyl alcohol has a viscosity of from 2.0 mPa·s to 15 mPa·s when measured as a 4% aqueous solution in demineralised water at 20° C., wherein the viscosity of the polyvinyl alcohol aqueous solution is measured using a Brookfield LV type viscometer with UL adapter as described in British Standard EN ISO 15023-2:2006 Annex E Brookfield Test method.

7. The liquid hand dishwashing cleaning composition according to claim 6, wherein the polyvinyl alcohol has a viscosity of from 2.5 mPa·s to 7.5 mPa·s when measured as a 4% aqueous solution in demineralised water at 20° C., wherein the viscosity of the polyvinyl alcohol aqueous solution is measured using a Brookfield LV type viscometer with UL adapter as described in British Standard EN ISO 15023-2:2006 Annex E Brookfield Test method.

8. The liquid hand dishwashing cleaning composition according to claim 1, wherein the liquid hand dishwashing cleaning composition comprises from 6% to 40% of the surfactant system by weight of the liquid hand dishwashing cleaning composition.

9. The liquid hand dishwashing cleaning composition according to claim 8, wherein the liquid hand dishwashing cleaning composition comprises from 15% to 35% of the surfactant system by weight of the liquid hand dishwashing cleaning composition.

10. The composition according to claim 1, wherein the alkyl sulphated anionic surfactant has an average degree of alkoxylation of less than 5.

11. The composition according to claim 10, wherein the alkyl sulphated anionic surfactant has an average degree of alkoxylation of from 0.5 to 2.0.

12. The composition according to claim 1, wherein the alkyl sulphated anionic surfactant has a weight average degree of branching of more than 10%.

13. The composition according to claim 12, wherein the alkyl sulphated anionic surfactant has a weight average degree of branching of between 30% and 60%.

14. The liquid hand dishwashing cleaning composition according to claim 1, wherein the surfactant system comprises from 60% to 90% of the anionic surfactant by weight of the surfactant system.

15. The liquid hand dishwashing cleaning composition according to claim 1, wherein the surfactant system further comprises a co-surfactant selected from the group consisting of an amphoteric surfactant, a zwitterionic surfactant and mixtures thereof.

16. The liquid hand dishwashing cleaning composition according to claim 15, wherein the surfactant system comprises amphoteric surfactant selected from amine oxide surfactant, wherein the amine oxide surfactant is selected from the group consisting of: alkyl dimethyl amine oxide, alkyl amido propyl dimethyl amine oxide, and mixtures thereof.

17. The liquid hand dishwashing cleaning composition according to claim 15, wherein the weight ratio of the anionic surfactant to the co-surfactant is from 1:1 to 8:1.

18. A method for hand washing dishes, using a liquid detergent composition comprising:

contacting dishes with the liquid detergent composition in its neat form, wherein the liquid detergent composition comprises:

from 5% to 50% of a surfactant system by weight of the liquid detergent composition, wherein the surfactant system comprises alkyl sulphated anionic surfactant, and has an average alkyl chain length of from 8 to 18 carbon atoms;

polyvinyl alcohol having a degree of hydrolysis of from 40% to less than 85%; and from 50% to 85% water by weight of the liquid detergent composition.

* * * * *